United States Patent [19]

Kwan

[11] 4,029,193

[45] June 14, 1977

[54] PRINTER HAVING A PLATEN WITH RESILIENT SEGMENTS

[75] Inventor: Okun Kwan, Trumbull, Conn.

[73] Assignee: Bunker Ramo Corporation, Oak Brook, Ill.

[22] Filed: Mar. 31, 1975

[21] Appl. No.: 563,528

[52] U.S. Cl. ..... 197/149; 197/1 R; 101/269

[51] Int. Cl.[2] ..... B41J 11/20

[58] Field of Search ..... 197/127 R, 144, 1 R, 197/149; 101/114, 287, 269, 93, 93.19

[56] References Cited

UNITED STATES PATENTS

| | | | |
|---|---|---|---|
| 2,149,478 | 3/1939 | Triner | 101/93.19 |
| 3,228,326 | 1/1966 | Childress | 101/114 |
| 3,776,341 | 12/1973 | Dobner | 197/127 R |
| 3,780,669 | 12/1973 | Geiger et al. | 101/269 |
| 3,837,461 | 9/1974 | Waibel | 101/287 |
| 3,838,640 | 10/1974 | Correll et al. | 101/269 |
| 3,838,641 | 10/1974 | McInnis | 101/269 |
| 3,868,008 | 2/1975 | Brumbaugh | 197/144 |
| 3,904,010 | 9/1975 | Krauss et al. | 197/1 R |
| 3,912,068 | 10/1975 | Kwan et al. | 197/149 |

FOREIGN PATENTS OR APPLICATIONS

| | | | |
|---|---|---|---|
| 1,224,696 | 3/1971 | United Kingdom | 101/93 |

OTHER PUBLICATIONS

"Pass Book for Disc Printer" P. Delapchier et al., IBM Technical Disclosure Bulletin, vol. 13, No. 8, p. 2350, 1/71.

Print Platen for Nonuniform Thickness Forms, F. L. Vinhich, IBM Technical Disclosure Bulletin, vol. 16, No. 2, 7/73, p. 605.

*Primary Examiner*—Edgar S. Burr
*Assistant Examiner*—William Pieprz
*Attorney, Agent, or Firm*—F. M. Arbuckle

[57] ABSTRACT

A bound booklet is opened and inserted into a guide. A platen, having individual spring biased segments, is positioned against the booklet covers while printing means move horizontally across the open pages of the booklet. A first platen segment contacts the front cover of the open booklet, while a second segment contacts the back cover. An intermediate shortened segment yields to the binding edge of the booklet. Thus, the varying thickness of the booklet is compensated for and a flat printing plane is presented to the printing means. A single leaf document may be accommodated, instead of a booklet. In the case of a single leaf, the resilient nature of the platen compensates for single leaf documents of different thickness, within a permissible range.

2 Claims, 8 Drawing Figures

PRINTER HAVING A PLATEN WITH RESILIENT SEGMENTS

FIELD OF THE INVENTION

The present invention relates to document printing devices, and more particularly to such a printer having a specially designed platen, having individual resilient segments for compensating for variations in thickness of the document to be printed on.

BRIEF DESCRIPTION OF THE PRIOR ART

In order to print on a document with most existing printers, the document must be brought into contact with a print element. the relative movement between the document and the print element required to bring them into contact may be effected by moving either the print element, the platen on which the document is mounted, or both. Normally, the movement or stroke of the element moved is substantially greater than the thickness of the document being printed on so that variations in the thickness of the document is not a factor limiting the capability of the printer or the print quality. To the extent that document thickness has been a factor, a certain amount of give has been provided in, for example, a platen mounting the document so as to maintain a substantially uniform location for the print surface. However, the time required for the printing of each character is, to some extent, determined by the length of the print stroke. Therefore, in high speed printers, an attempt has been made to minimize the length of this stroke. For example, some printers utilize as the print element a matrix of wires which are moved only five to forty-five thousandths of an inch during the printing of each character. On the average, these wires are moved from fifteen to twenty thousandths of an inch.

Heretofore, high speed printers of this type have been employed, for example, to generate print-outs of information from a data processor. In these applications, the document being printed on is of a single thickness and fairly good control of document quality and thickness can be maintained. However, when it is attempted to utilize print elements of this type in, for example, the printer of a bank teller machine, the small stroke of the element becomes a problem. In such applications, the printer may be called upon to operate with a variety of different types of documents such as, for example, bank passbooks, checkbooks, installment payment books and the like. In addition to the various types and quality of documents, thicknesses will vary depending on the page of the document which is being printed on and, since the document may be subject to a substantial amount of handling prior to printing, the quality and thickness of the document may be further varied. The small stroke of the print element requires, however, that the document be in exact registration with a print surface regardless of document thickness or quality.

In an earlier patent application, Ser. No. 433,096 filed Jan. 14, 1974, the present inventor and other coinventors disclosed a printer adapted to perform print operations on various documents having different thickness. The printer disclosed in the application has a document guide means or receiving chute with first and second spaced apart sides. At least a portion of the first side of the chute is formed from a pair of substantially flat elongated surfaces included as part of a print defining means. The surfaces are in a common plane which is defined as the print plane and are spaced by a predetermined distance to form an elongated opening. An elongated platen, the width of which is greater than said predetermined distance, is mounted adjacent to the second side of the chute in a position directly opposite from the elongated opening. A means is provided for acting upon the platen mounting means for moving the platen between a first position in which it does not interact with a document in the chute and a second position in which the platen clamps a document in the chute tightly against both of the elongated surfaces. The portion of the document adjacent the elongated opening is thus precisely positioned in the print plane. A print means is mounted for movement along the elongated opening and is adapted, during a print operation, to selectively project through the opening to impact a document clamped against the elongated surfaces. Control means are provided which are operative to cause the means for moving the platen to move the platen to the second position only when a print operation is to be performed, the control means being operative when the performance of a print operation has been completed for returning the platen to the first position. In order to further compensate for variations in document thickness (within a predetermined range of thickness), the means for mounting the platen includes means for resiliently biasing the platen toward the first side of the chute. This permits a document to be clamped against the elongated surfaces with substantially uniform pressure regardless of document thickness.

Although the approach disclosed in the application is capable of handling documents of different thickness, the structure set forth requires that the portion of the document on the platen has a uniform thickness. Accordingly, a problem arises where the document is in the form of an open booklet, having portions of different thickness, positioned on the platen simultaneously. Accordingly, a platen is required to compensate for the varying thickness of different portions of the document, laying on the platen, at a given time. Further, a platen must accommodate the binding or centerfold, which presents a bulging surface to the platen.

BRIEF DESCRIPTION OF THE PRESENT INVENTION

The present invention is an improvement of the printer disclosed in the referenced application. More particularly, the improved printer of the present invention includes a specially designed platen that has individual segments that are independently resilient. The segments are positioned to respectively engage the different portions of a booklet document having varying thickness. The capability of the segments to yield by different amounts permits a compensation to be made of portions of a single document having different thickness.

Similarly, the resilient structure of the platen allows a single leaf document to be handled. The thickness of such a single leaf document may vary within a determinable range.

The foregoing and other objects, features and advantages of the invention will be apparent from the following more particular description of a preferred embodiment of the invention as illustrated in the accompanying drawings.

DESCRIPTION OF THE PREFERRED EMBODIMENT

Figure 1:
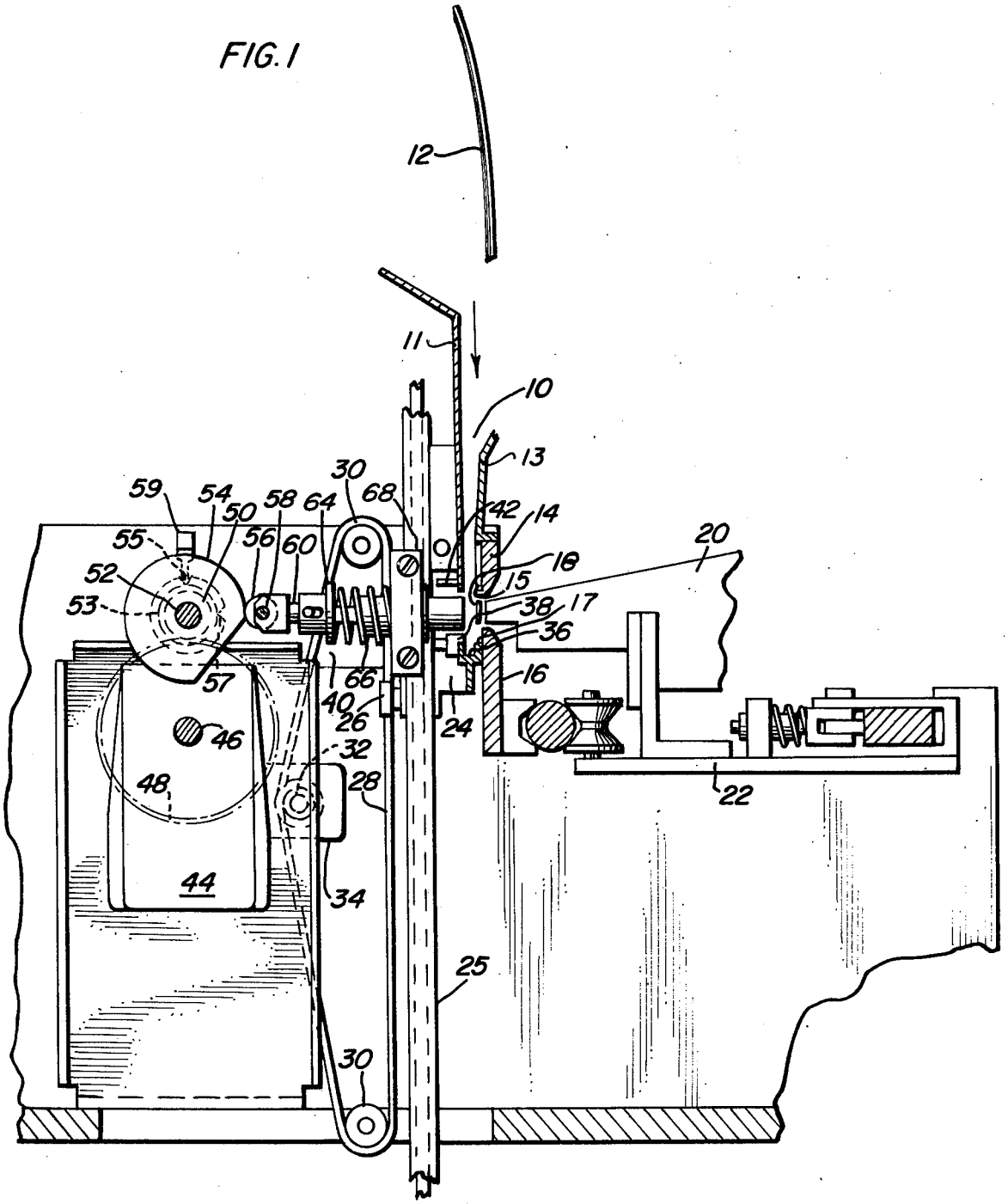
FIG. 1 is a cut-away side view of a bank printer device incorporating the document thickness compensating mechanism of this invention, showing the mechanism in an unoperated position.

Referring to the figures, it is seen that the printer of this invention includes a chute 10 which is adapted to receive a document 12 to be printed on. For purposes of the discussion to follow, the document 12 will be assumed to be a bank passbook with its centerfold positioned vertically, and the printer to be part of a bank teller terminal. The mouth and upper open portion of chute 10 are defined by a pair of guides 11 and 13. A pair of elongated sensing gauge bars 14 and 16 extend below guide 13, the bars 14 and 16 being spaced to provide an opening 18 therebetween into which a print head 20 projects. The flat elongated surfaces 15 and 17 of the aforementioned bars 14 and 16 define both a side of chute 10 and the plane in which printing occurs (the print plane) in the area adjacent opening 18. The space between head 20 and the print plane is somewhat less than the stroke length of print wires (not shown) in the head (for example, 20 mils). Where an inked ribbon is required, it will fill part of this space. While slot 18 is not visible in FIG. 3, it extends under bar 14 from left to right (as viewed in FIG. 3) for a distance at least equal to the maximum length of a line to be printed. This would normally be substantially equal to the width of the chute 10.

While the nature of print head 20 does not form part of the present invention, it will, for purposes of illustration, be assumed to be a matrix wire print head of a type now commercially available from a number of sources. A matrix wire print head of this type is described in U.S. Pat. No. 3,592,311, entitled "Wire Printing Head" issued to A. S. Chou et al. on July 13, 1971, and in U.S. Pat. No. 3,690,431, entitled "Print Head Assembly Containing Solenoids" issued to Robert Howard on Sept. 12, 1972. Print head 20 is mounted on a carriage 22 which may be moved by a suitable drive mechanism in a direction from left to right as viewed in FIG. 3. The carriage may thus be moved to permit print head 20 to be utilized to record a line of characters on document 12. The mechanisms for moving carriage 22 and for controlling the printing of characters by head 20 may be of conventional design and do not form part of the present invention. A description of these elements will therefore not be provided.

Figure 2:
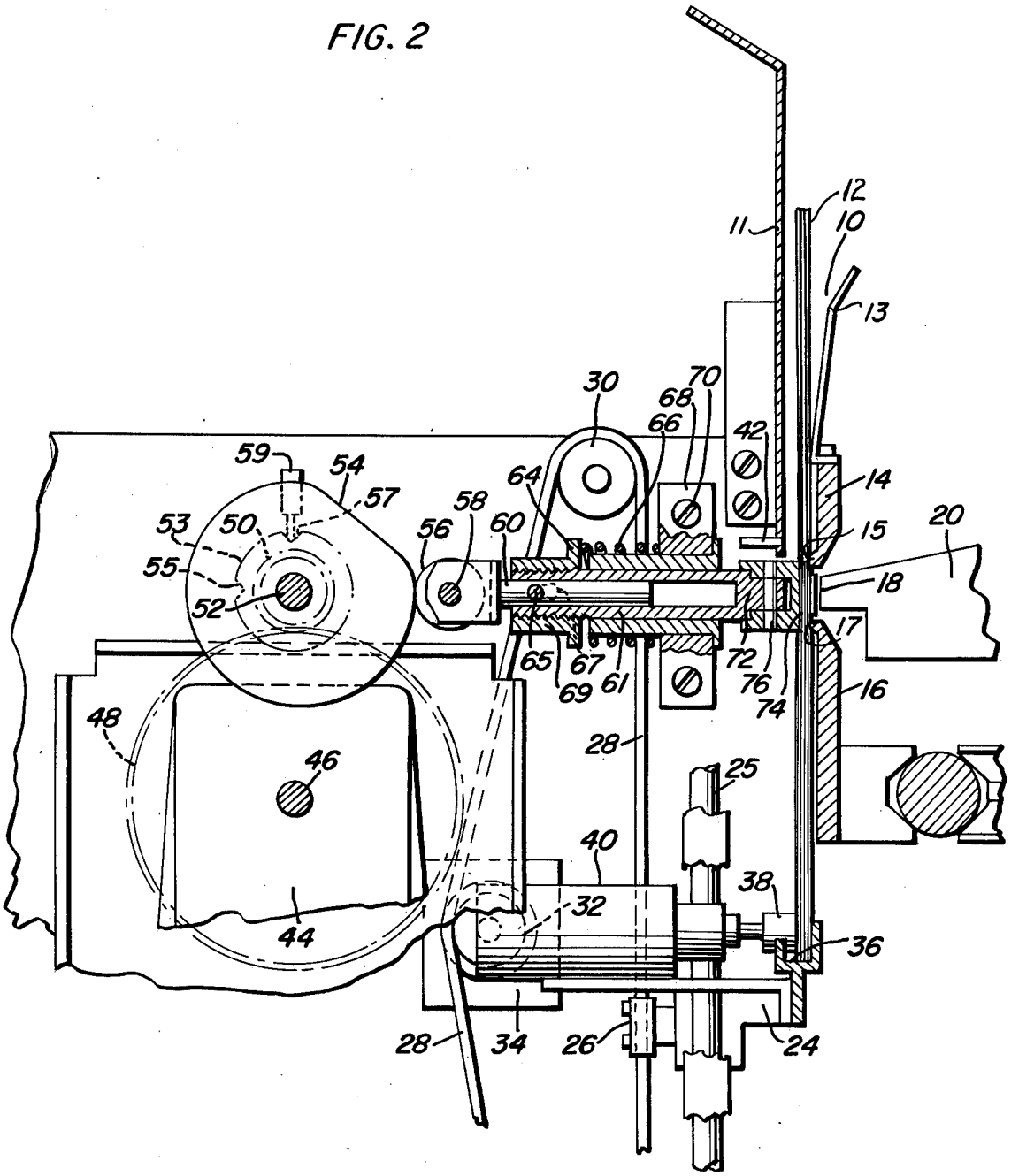
FIG. 2 is an enlarged cut-away side view of a portion of the printer shown in FIG. 1 including the document thickness compensation mechanism showing the mechanism in an operated position.

Studying FIG. 2, a document inserted into chute 10 comes to rest in a holder assembly 24 for a passbook, which holder assembly is mounted for vertical movement on shaft 25. Holder assembly 24 is attached by a clamp 26 to a timing belt 28 which passes over idler pulleys 30 and engages pulley 32. Main pulley 32 is driven by bi-directional motor 34.

Holder assembly 24 has a document receiving slot 36 in which the lower end of the document may be clamped by the plunger 38 of hold solenoid 40. As will be seen shortly, hold solenoid 40 is activated in response to the detection of a document in chute 10 by a photo-detector 42.

Figure 3:
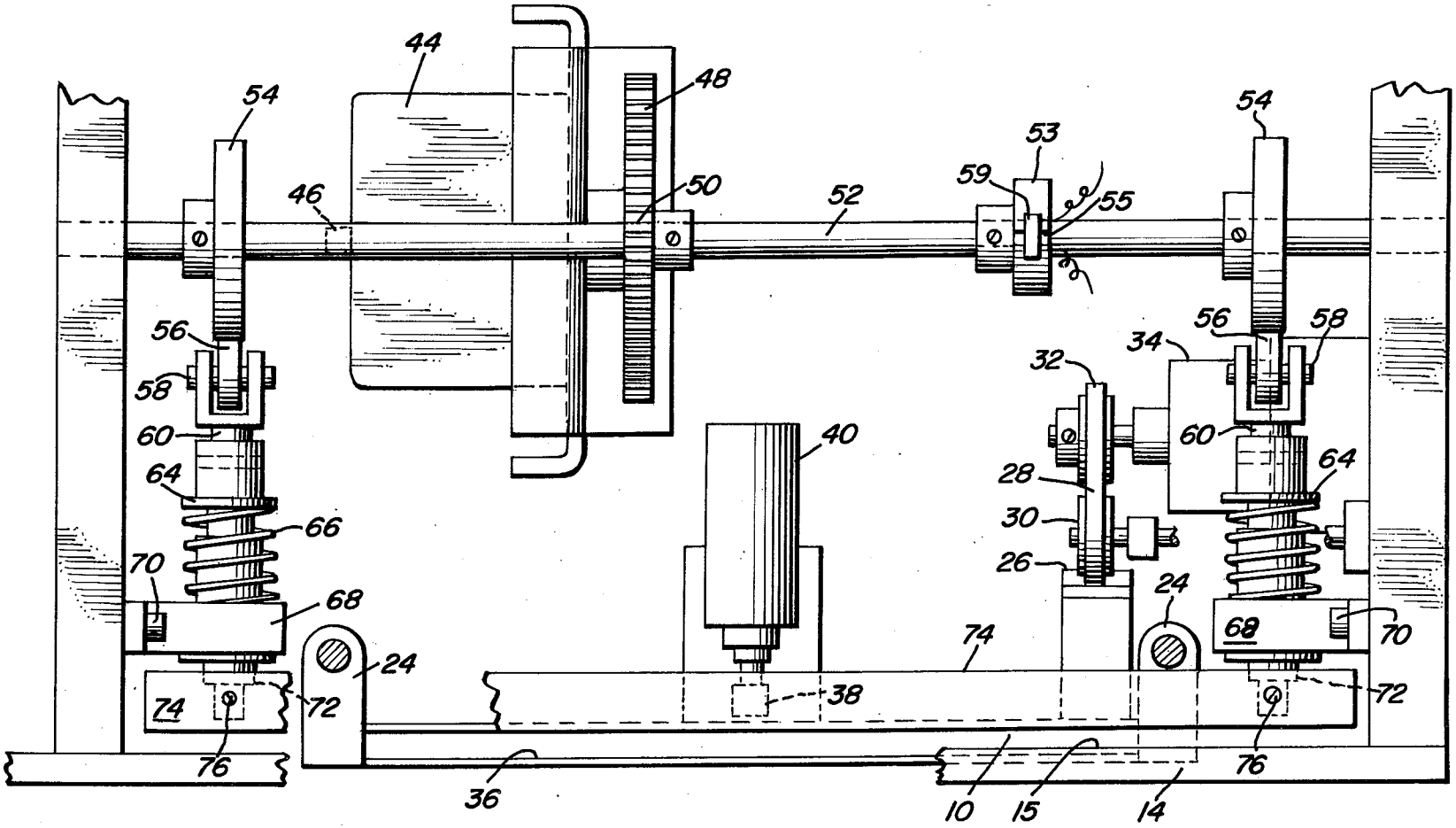
FIG. 3 is a top view of a portion of the printer shown in FIG. 2.

Viewing FIG. 3, the document thickness compensation mechanism of the invention includes a motor 44 which is connected by a shaft 46 to a gear 48. Gear 48 engages a smaller gear 50 mounted on shaft 52. Also mounted on shaft 52 is a cam 53 having distortions such as grooves 55 and 57 (FIG. 2) formed thereon and a pair of cams 54 which are normally positioned to have their low dwells in contact with corresponding cam follower rollers 56 (see FIGS. 1 and 3). A switch 59 is positioned to be closed when any portion of cam 53 except grooves 55 and 57 are adjacent to it. Each cam follower roller 56 is attached by a pin 58 to a corresponding plunger mechanism 60. As may be best seen in FIG. 2, each plunger 60 is fixedly positioned in a cylinder 61. A collar 69 having a flange 64 is screw fitted to the outside of each cylinder 61 at the end thereof adjacent roller 56. Each cylinder 61 is supported in a sleeve 71 mounted in a bracket 68. The brackets 68 are secured to the printer housing by screws 70. A compression spring 66 is captivated between end flange 64 and bracket 68. An elongated platen 74 extending the width of chute 10 is secured to projection 72 of cylinders 61 by screws or pins 76.

When the elements are positioned as shown in FIG. 1, platen 74 is out of chute 10 permitting document 12 to be inserted into the chute and easily moved therein. When the cams 54 are rotated to a high dwell position, as shown in FIG. 2, the platen is moved forward into the chute pressing the document firmly against flat elongated surfaces 15 and 17 of bars 14 and 16, assuring that the document is in precise registration with the printing surface. Individual segments of the platen yield separately, as explained hereinafter, in amounts which vary with the thickness of the document and thus serve to compensate for variations in thickness between different parts of the document. Thus, both the position and the pressure on the document remain substantially uniform across the entire document face, provided the thickness of the document is within a predetermined range of thickness which the printer is designed to accept.

Up to this point, the present invention has incorporated the structure as disclosed in the previously mentioned application. A major point of departure between the present invention and the invention of the referenced application is the platen. In the earlier referenced application, a resiliently mounted platen is provided for handling one portion of a document which has a uniform thickness throughout that portion. Thus, the previously disclosed platen is capable of compensating for varying thickness in a bankbook that is inserted into the unit with the centerfold disposed horizontally. However, in applications where a bankbook is inserted into the unit with the centerfold disposed vertically, the previously disclosed platen would not operate satisfactorily. This is due to the fact that a document so inserted into the unit will have portions on either side of the centerfold with different thickness. In order to provide document support for a document having thickness variations across the print plane, the present invention includes a multi-segmented platen having individual segments that are resiliently mounted with respect to one another.

Figure 4:
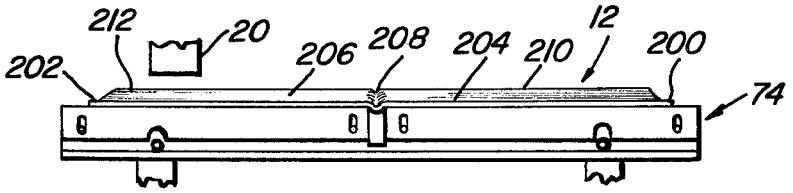
FIG. 4 is a simplified elevational view illustrating the disposition of a thickness compensating platen, relative to a booklet document.

Attention is directed to FIGS. 4–8 which illustrate the particular construction of the platen utilized in the present invention. In FIG. 4, a document in the form of a booklet is generally indicated by reference numeral 12 and has a front cover 200 and a back cover 202. A first portion 204 includes a number of pages resting against the front cover 200, while a second portion 206 comprises a number of pages resting against the rear cover 202. The booklet rests against the platen with its centerfold 208 generally positioned at a midpoint along the length of the platen. However, it is not mandatory that the centerfold 208 be positioned at the midpoint. The primary object of the platen is to adjust for thickness variations between portions 204 and 206 so that a planar surface is presented for printing by open pages 210 and 212. As shown in FIG. 4, the print head 20 scans across a line of the open pages 210, 212 from right to left, or vice versa. It is to be understood that FIG. 4 represents a simplified view for purposes of showing the positional relationship between portions of a booklet document and the particular platen of the present invention.

Figure 5:
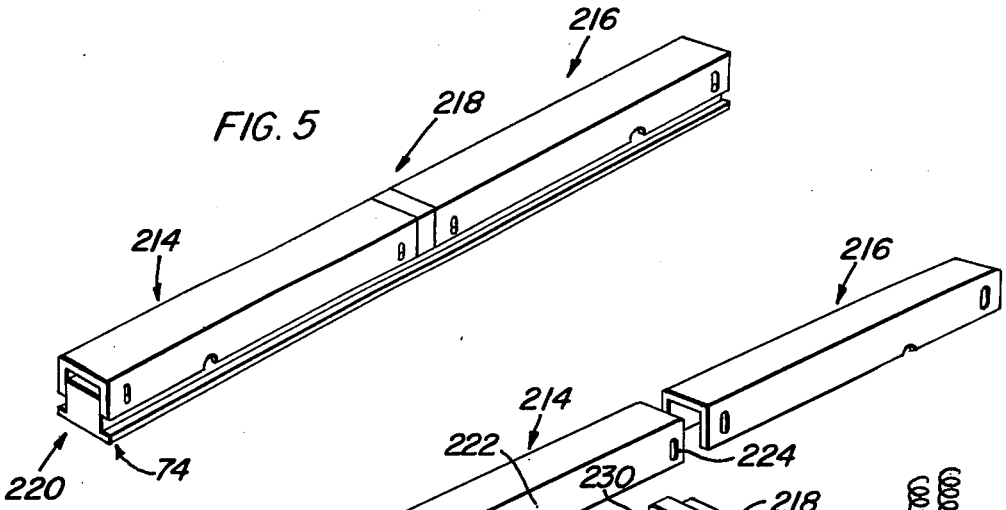
FIG. 5 is a perspective view of the thickness compensating platen shown in FIG. 4.

FIG. 5 is a schematic view of the platen clearly illustrating the three separately mounted resilient segments 214, 216 and 218 that displace themselves in an independent manner, relative to an elongated support bar 220. The segments 214 and 216 are pushed against the front and back covers 200 and 202 of the booklet document shown in FIG. 4. An intermediate third segment 218 yields under pressure from the bulging centerfold that it confronts.

Figure 6:
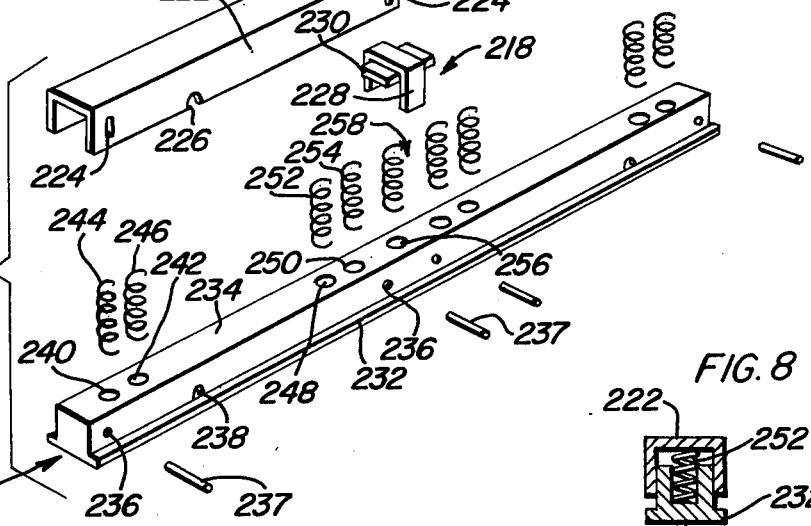
FIG. 6 is a disassembled view of the platen shown in FIG. 5.
Figure 8:
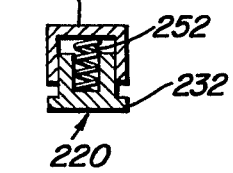
FIG. 8 is a transverse sectional view of the platen, taken along section lines 8—8 in FIG. 7.
Figure 7:
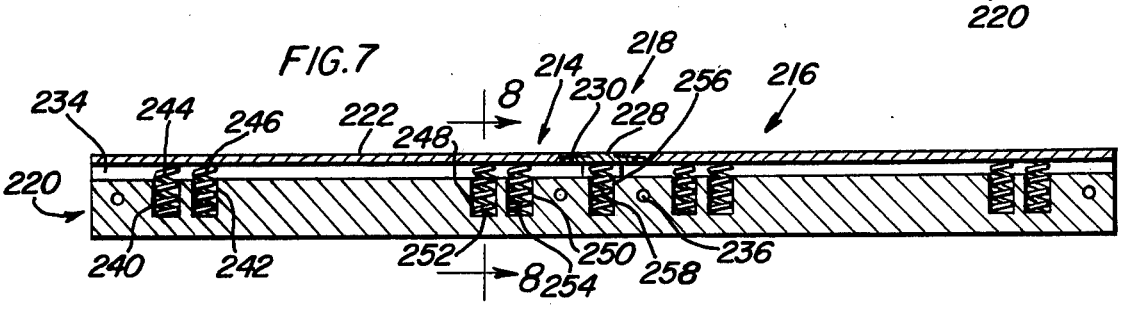
FIG. 7 is a longitudinal sectional view of the platen shown in FIG. 6.

Referring to FIG. 6, the segment 214 includes a channel-shaped member 222 having a generally U-shaped cross section. Transverse slots 224 are formed in the oppositely positioned sides of the member 222 to permit the passage of a pin therethrough that secures the channel-shaped member to the bar support 220, in a resilient manner to be discussed. An opening 226 is likewise formed through the opposite sides of the member 222 to permit the passage of a pin 76, as previously discussed in connection with FIGS. 1 and 2.

The intermediate section 218 shown in FIG. 6 is more particularly comprised of a shortened channel-shaped member 228 having a crosspiece 230 fixedly mounted under the bight portion of the member 228. In addition, the crosspiece 230 contacts the underside of adjacently positioned areas of members 214 and 216. The purpose of the crosspiece 230 is to maintain the transverse edges of member 228 in contacting relation with juxtaposed edges of the channel-shaped members of segments 214 and 216.

The support bar 220 includes a flange 232 which is integrally formed with an elongated bar portion 234. Transverse bores 236 are formed at the ends and intermediate points along the length of the bar portion 234 to receive press-fitted pins 237. The pins also pass through the slots 224 in the channel members of segments 214 and 216. In order to allow free movement of the segment channel members, the slots 224 are vertically oblong. Bores 238 are formed along the bar portion 234. As previously mentioned, these accommodate pins 76, as previously shown in FIGS. 1 and 2.

Bores 240, and 242 accommodate elongated coil springs 244 and 246. These springs resiliently mount the left end of channel member 222. In a similar fashion, bores 248 and 250 accommodate springs 252 and 254 for resiliently mounting the right end of the channel member 222. It is to be understood that the other channel member associated with segment 216 is likewise resiliently mounted to the support bar 220. In fact, the indicated embodiment is symmetrical about the intermediate segment 218.

Midway along the length of the bar portion 220 is a bore 256 that accommodates a single spring 258. The upper end of this spring contacts the underside of crosspiece 230. The shortened channel-shaped member 228 is thus resiliently mounted by the spring 258.

In view of the particular structure of the platen as disclosed hereinbefore, it will be appreciated that a novel multi-segmented platen construction is presented. More particularly, the construction enables the insertion of a booklet-type document into the printer shown in FIGS. 1 and 2, with the centerfold positioned vertically. The individually resiliently mounted segments of the platen accommodate different portions of the booklet document 12 that have different thickness, relative to each other. The result is a printer having the capability of presenting a flat surface, constituting the coplanar pages of an open document 12, which faces the print head 20.

Similarly, the resilient structure of the platen allows a single leaf document to be handled. The thickness of such a single leaf document may vary within a determinable range.

It should be understood that the invention is not limited to the exact details of construction shown and described herein for obvious modifications will occur to persons skilled in the art.

What is claimed is:

1. A printer platen for alternatively providing a printer support surface for single sheets, multiple sheets or documents of varying thickness, comprising:

an elongated support means for mounting other platen components thereto;

first and second document contacting members overlying the support means and normally positioned in aligned spaced relation to each other;

a third document contacting member overlying the support means normally positioned in intermediate aligned abutting relationship with the first and second document carrying members;

a plurality of spring means, each connected between the support means and a respective document contacting member;

means connected between the support means and the document contacting members for normally maintaining a continuous surface between all of the members;

wherein the continuous surface is planar for a document of uniform thickness and further wherein the third member may yield relative to the first and second members for supporting the bulge of a document centerfold while first and second flat portions of a document are supported by the first and second members, in a manner permitting continuous line printing across the centerfold.

2. A printer platen comprising:

a. an elongated support means for mounting other platen components thereto;

b. a plurality of document contacting members resiliently mounted to the support means, each document contacting member having a generally channel shape positioned over the support means, the channel-shaped members being normally disposed in aligned abutting relationship with each other, the channel-shaped members including first and second members of substantially identical length and a third intermediately positioned foreshortened member;

c. a plurality of resilient means mounted at a first end thereof to the support means, an opposite end of the resilient means respectively biasing each document contacting member; and d. fastener means connecting the document contacting members to the support means for maintaining the platen in an assembled condition, the fastener means normally maintaining a continuous surface between all of the members;

e. wherein the continuous surface is planar for a document of uniform thickness and further wherein the third member may yield relative to the first and second members for supporting the bulge of a document centerfold while first and second flat portions of a document are supported by the first and second members, in a manner permitting continuous line printing across the centerfold.

* * * * *